US006681935B1

(12) United States Patent
Lewis

(10) Patent No.: US 6,681,935 B1
(45) Date of Patent: Jan. 27, 2004

(54) METHOD OF PROVIDING A THERAPEUTIC REGIMEN AND PREFABRICATED CONTAINER THEREFOR

(76) Inventor: Graham L. Lewis, 1887 Dry Hollow Rd., Chestnut Ridge, MO (US) 65630

( * ) Notice: Subject to any disclaimer, the term of this patent is extended or adjusted under 35 U.S.C. 154(b) by 95 days.

(21) Appl. No.: 10/115,329

(22) Filed: Apr. 2, 2002

(51) Int. Cl.[7] ..... B65B 5/00; B65D 83/04
(52) U.S. Cl. ..... 206/534; 53/411; 53/449
(58) Field of Search ..... 53/411, 449; 206/528, 206/531, 532, 538, 539, 534, 459.5; 101/483

(56) References Cited

U.S. PATENT DOCUMENTS

| | | | | | |
|---|---|---|---|---|---|
| 3,497,982 | A | * | 3/1970 | Schulz | 40/312 |
| 3,503,493 | A | * | 3/1970 | Nagy | 206/232 |
| 3,621,992 | A | | 11/1971 | Osborne et al. | |
| 3,630,346 | A | | 12/1971 | Burnside | |
| 3,780,856 | A | | 12/1973 | Braverman | |
| 4,039,080 | A | * | 8/1977 | Cappuccilli | 206/534 |
| 4,473,156 | A | * | 9/1984 | Martin | 206/534 |
| 4,593,819 | A | * | 6/1986 | Will | 206/538 |
| 4,889,238 | A | | 12/1989 | Batchelor | |
| 4,974,729 | A | | 12/1990 | Steinnagel | |
| 5,014,851 | A | | 5/1991 | Wick | |
| 5,109,984 | A | * | 5/1992 | Romick | 206/531 |
| 5,323,907 | A | * | 6/1994 | Kalvelage | 206/531 |
| 5,339,960 | A | | 8/1994 | Price | |
| RE35,445 | E | * | 2/1997 | Pora | 206/532 |
| 5,788,079 | A | * | 8/1998 | Bouthiette | 206/534 |
| 5,873,466 | A | | 2/1999 | Hulick | |
| 6,155,423 | A | * | 12/2000 | Katzner et al. | 206/531 |
| 6,273,260 | B1 | * | 8/2001 | ColDepietro et al. | 206/532 |

OTHER PUBLICATIONS

Sharperimage.com web page for Travel Vitamin & Pill Organizer.

* cited by examiner

*Primary Examiner*—Jim Foster
(74) *Attorney, Agent, or Firm*—Richard L. Marsh

(57) ABSTRACT

An integrated medicament package comprises a prefabricated medicament container having a plurality of initially open top blisters, a closure cover affixed to one marginal edge thereof by at least one living hinge, the closure cover having at least one clasp on an open end of the closure cover opposite the living hinge, the blisters arranged in rows and columns separated by longitudinal and transverse shoulders, at least one of the longitudinal and the transverse shoulders having perforations therethrough wherein the prefabricated medicine container is adapted to be separated along the perforations into a plurality of units, and a sealing sheet with medicament information at a location corresponding to the at least one said plurality of blister such that the medicament information on the outside surface of the sealing sheet corresponds with the medicament in the blisters, the medicament information comprising the name of the patient, the name of the medicament, the dosage of the medicament, the time of day, the day of week and the calendar date for the patient to take the medicament in the blister, the sealing sheet when removed from the location indicates to the patient that the medicament has been taken.

20 Claims, 2 Drawing Sheets

METHOD OF PROVIDING A THERAPEUTIC REGIMEN AND PREFABRICATED CONTAINER THEREFOR

BACKGROUND OF THE INVENTION

1. Field of the Invention

This invention relates to a method of providing a therapeutic regimen for a patient wherein specific medicament information comprising at least one of the name of the patient, the name of the medicament, the dosage of the medicament, the time of day, the day of week and the Julian date for the patient to take the medicament is provided on each of a plurality of blisters of a prefabricated medicament container and wherein the first medicament to be taken by the patient after dispensing is arranged in a first position in a first column and a first row of the prefabricated container wherein subsequent medicaments to be taken by the patient follow in sequential fashion.

2. Prior Art Statement

It is known to first provide a printed sheet having dosage information thereon and thereafter adhere previously prepackaged strip form blister packs onto the sheet alongside the printed material. The person administering the medicine removes an individual blister from the printed sheet, administers the medicine and records certain time related information for control purposes upon the sheet and upon dispensing all the medication contained on the sheet, returns the card with the blisters removed therefrom to the dispensing pharmacy as a permanent control record. For instance, see the U.S. Pat. No. 3,621,992 issued on Nov. 23, 1971, to Osborne, et al.

It is also known to manually package solid medication into integrally connected individual sealed plastic blisters covering the backing on the blisters with a label strip having drug indicia thereon as a substitute for dispensing medicine in souffle cups. For instance, see the U.S. Pat. No. 3,630,346 issued on Dec. 28, 1971 to Carl Burnside.

It is further known to provide a medicinal dispensing device comprising 25 units arranged in a square having means for accessing the contents of blisters of a blister pack by lifting the corner edge of a lidding material by gripping a corner edge of the lidding in a cutout between selected blisters. For instance, see U.S. Pat. No. 3,780,856 issued on Dec. 25, 1973 to Milton Braverman.

Additionally, it is known to provide a multiplicity of blister cards having medicaments carried on the blister cards in sequential order on the individual cards and from card to card wherein the blister cards are placed in a stacked array in a base adapted to support the stack. For instance, see the U.S. Pat. No. 4,889,238 issued on Dec. 26, 1989 to Jay A. Batchelor.

It is still further known to provide a reminder system for providing an indication when a dose of medication should be taken by providing a calendar type blister-pack initially dispensed by a physician with a separable time reminder device indicating a predetermined dosage schedule. For instance, see the U.S. Pat. No. 4,974,729 issued on Dec. 4, 1990 to Kent P. Steinnagel.

Yet another known package assembly for dispensing medications comprises an empty blister sheet selected by the pharmacist who then fills the blisters with pharmaceutical medications, positions a lidding sheet over the blisters and presses the cohesive layers together. The lidding sheet has a paper backing sheet with appropriate printed information at each blister location, the information including a given time for a given medication in the corresponding blister. The completed assembly is then placed in a framework which provides support for pushing the medication through the lidding sheet. For instance, see the U.S. Pat. No. 5,014,851 issued on May 14, 1991 to John J. Wick. Considerable assembly is required to make a completed package and the frame surrounding the assembly must be sufficiently strong to resist breakage while pushing the medication through the lidding sheet.

Another medication containing package known in the art comprises a tear-off tab having a date on the tab and an intermediate layer with a second breakaway panel aligned with a blister chamber containing the prepackaged medication. After the date tab is removed, the medicine in the blister pack is then pushed through the foil lidding material. For instance, see the U.S. Pat. No. 5,339,960 issued on Aug. 23, 1994 to Jerry Price. The date tab is preprinted and contains only dosage information, no other patient or medication information is available on the package. Additionally, the package is specifically made difficult to open to prevent children from opening the package blisters.

It is also known to provide a blister for the user to store a part of a medicament for later use. In some cases, a medicament is not available in a proper dosage and thus a multiple of the dosage is provided by the pharmacist. The patient then divides the dosage as directed and with this device then stores the unused part in a blister having a storage strip for covering the unused part of the medicament. For instance, see the U.S. Pat. No. 5,873,466 issued on Feb. 23, 1999 to Martin Hulick. Patient and medicament information is presumably provided on a separate sheet as is conventional and thus no information appears on the package to indicate to the patient that a particular medicament has been taken.

Finally, it is known to provide a travel vitamin and pill organizer which may hold one of eight interchangeable discs wherein the organizer has a LCD for displaying the current time and scheduled time for the next dose. For instance, see the Travel Vitamin & Pill Organizer available at www.sharperimage.com. This device must have the LCD reset each time one of the discs is replaced. No patient nor pill information is available on the organizer to indicate to the patient what pill is being taken.

SUMMARY OF THE INVENTION

Although there are a number of prepackaged medicaments on the market which contain preprinted information comprising the name of the medication, the dosage and possibly a date tab, there is not available a blister package having specific patient, medicament, date and time information printed on the cover of each blister at the time of dispensing of the medication, which when removed by the patient, indicates to the patient that the medication has been taken. Therefore, it is an object of this invention to provide a prefabricated medicine container package having multiple blisters, or pockets, to hold individual or multiple dosages of medicine therein. The container is constructed of a disposable material, such as plastic or cardboard, etc. The number and arrangement of the pill blisters in a particular package will typically correspond to the frequency of the particular medicine dosage for a particular patient, such as a particular package having three rows and seven columns of pill blisters for medicine to be taken by a patient three times a day for one week, although any number of rows and columns may be used. When filling a medical prescription, a pharmacist may deposit the appropriate dosage of medicine in each blister and thereafter seal the blisters with a film of appropriate material in a substantially airtight manner. The film may be constructed of a thin layer of aluminum or a clear plastic film, self adhesive label, etc., and is normally applied by a pharmacist. The film may be applied by hand or by a machine at the pharmacy.

It is also an object of this invention to provide a method of providing a therapeutic regimen for a patient comprising the step of dispensing at least one medicament of the therapeutic regimen into a prefabricated medicament container, the step of printing an outside surface of a sealing sheet with medicament information, the step of arranging the medicament in the prefabricated medicament container wherein the medicament to be first taken by the patient after the step of dispensing the medicament into the prefabricated medicament container is in a first position in a first column and a first position in a first row of the prefabricated medicament container, the step of aligning the medicament information printed on the sealing sheet with the medicament in the prefabricated medicament container, the step of closing the prefabricated medicament container by adhering the sealing sheet to the prefabricated medicament container, the step of closing a closure cover, which may be child-resistant, over the prefabricated medicament container, the step of clasping a clasp to a marginal edge of the prefabricated medicament container and the step of providing means for removing a piece of the sealing sheet from the blister wherein the patient, after removing the piece of the sealing sheet and discarding the piece, removing the medicament from the blister and taking the medicament is subsequently reminded that the medicament has been taken by the absence of the piece from the prefabricated medicament container.

A feature of this invention is a method of providing a medicament and a prefabricated medicament container therefor, the prefabricated medicament container having a plurality of blisters covered with a printed information sheet wherein the medicament in one of the plurality of blisters further comprises the step of providing a different medicament in an adjacent one of the plurality of blisters, the medicament in the adjacent one of the plurality of blisters to be taken by a patient at a time spaced from the time the patient is to take medicament is a first one of the blisters wherein the time of taking the medicament in one blister is specified in the printed information covering the one blister and the time of taking the medicament in the adjacent blister is specified in the printed information covering the adjacent blister.

An additional feature of this invention is a method of providing a medicament and a prefabricated medicament container therefor, the prefabricated medicament container having a plurality of blisters covered with a printed information sheet further comprises the step of providing a different medicament in an adjacent one of the plurality of blisters, the medicament in the adjacent one of the plurality of blisters to be taken by a patient at the same time as the time the patient is to take medicament in a first one of the blisters wherein the time of taking the medicament in the one blister is specified in the printed information covering the one blister and the time of taking the medicament in the adjacent blister is also specified in the printed information covering the adjacent blister.

An aim of this invention is to provide a method of supplying a medicament and a prefabricated medicament container therefor, the prefabricated medicament container having a plurality of blisters covered with a printed information sheet further comprises the step of providing the same medicament in an adjacent one of the plurality of blisters, the medicament in the adjacent one of the plurality of blisters to be taken by the patient at a time spaced from the time the patient is to take the medicament in the first one of the plurality of blisters wherein the printed information over each blister corresponds to the medicament in the respective blister.

A goal of this invention is a method of administering a medicament and a prefabricated medicament container therefor, the prefabricated medicament container having a plurality of initially open blisters thereafter covered with a printed information sealing sheet wherein perforations are disposed through the sealing sheet which are aligned with perforations provided in longitudinal and/or transverse shoulders of the prefabricated medicament container during the step of closing the initially open blisters.

An attribute of this invention is a method of administering a medicament and a prefabricated medicament container therefor, the prefabricated medicament container having a plurality of initially open blisters thereafter covered with a printed information sealing sheet wherein perforations are disposed through the closure cover, these perforations in the closure cover aligned with the perforations in the longitudinal and/or the transverse shoulders of the prefabricated medicament container and the perforations in the sealing sheet.

A purpose of this invention is to provide a method of dispensing a medicament and a prefabricated medicament container therefor, the prefabricated medicament container having a plurality of initially open blisters thereafter covered with a printed information sealing sheet wherein perforations in the closure cover are extended through a living hinge lengthwise of the closure cover and through a clasp on the cover wherein the closure cover, the prefabricated medicament container and the sealing sheet are separated at the perforations into separate columnar units wherein the specific medicament to be taken by the patient as printed on the outside surface of the sealing sheet at substantially the same time of each day allows the patient to place the columnar unit at a location where the patient is most likely to reside at the time specified for taking the specific medicament.

Another goal of this invention is to provide a method of dispensing a medicament and a prefabricated medicament container therefor, the prefabricated medicament container having a plurality of initially open blisters thereafter covered with a printed information sealing sheet wherein perforations are disposed through the sealing sheet transversely across the closure cover thereby establishing transverse perforations through the closure cover, the prefabricated medicament container and the sealing sheet. Thus, the closure cover, the prefabricated medicament container and the sealing sheet may be separated at the perforations into separate row-like units, wherein a daily regimen of medicament captured in the plurality of blisters of the separate row-like unit to be taken by the patient as printed on the outside surface of the sealing sheet covering the row-like unit allows the patient to carry the separate row-like unit while remote from the location wherein the patient retains the remainder of the regimen.

Another feature of this invention is to provide a prefabricated medicine container package having multiple blisters, or pockets, to hold medicine therein, covering the multiple blisters having the dosages of medicine therein with a cover sheet that contains dosage and patient information and providing a section of the sealing sheet that extends across a living hinge of the prefabricated medicine container that is adhered to an inside surface of a closure cover, the section having drug reaction and side effect information relative to the medicament contained in the blisters printed on an exterior surface thereof and/or in a separate flyer inserted into the completed integrated medicament package between the cover sheet and the closure cover.

Another purpose of this invention is to provide a prefabricated medicine container having multiple blisters, or pockets, to hold medicine therein wherein in a step of dispensing the medicament of a therapeutic regimen in at least one of the initially open blister comprises the step of dispensing a plurality of distinct medicaments in the one initially open blister.

Another aim of this invention is to provide a method of dispensing a medicament and a prefabricated medicament container therefor, the prefabricated medicament container having a plurality of initially open blisters thereafter covered with a printed information sealing sheet whereafter the therapeutic regimen is dispensed in the prefabricated medicament container, the method provides for closing the prefabricated medicament container with the sealing sheet, closing a closure cover over the prefabricated medicament container by clasping at least one clasp over a marginal edge of the prefabricated medicament container and also comprises the step of providing the medicament in the blisters corresponding to one week's therapeutic regimen arranged in seven daily row-like units and morning, midday and evening columnar units.

Another attribute of this invention is to provide a method of dispensing a medicament and a prefabricated medicament container therefor, the prefabricated medicament container having a plurality of initially open blisters thereafter covered with a printed information sealing sheet whereafter the therapeutic regimen is dispensed in the prefabricated medicament container. The method provides for closing the prefabricated medicament container with the sealing sheet, closing a closure cover over the prefabricated medicament container by clasping at least one clasp over a marginal edge of the prefabricated medicament container and also comprises the step of providing the medicament in the plurality of blisters corresponding to one month's therapeutic regimen arranged in seven row-like units corresponding to the days of the week and four weekly columnar units corresponding to the weeks of the month.

These and other objects of the invention will become apparent by a careful reading and a broad interpretation of the scope of the following description. For instance, it is fully within the scope of this invention to provide a medicament in a single column for a patient requiring only daily dosages of the medicament or two or more columns for a patient requiring more than one dosage of medicament.

DESCRIPTION OF THE PREFERRED EMBODIMENTS

While the various features of this invention are hereinafter described and illustrated as a method of providing a therapeutic regimen for a patient that comprises dispensing a medicament of a therapeutic regimen into a prefabricated medicament container, printing an outside surface of a sealing sheet with medicament information, arranging the medicament in the container wherein the medicament to be first taken by the patient after dispensing is in a first position in a plurality of columns and rows, aligning the medicament information printed on the sealing sheet with the medicament, closing the prefabricated medicament container by adhering the sealing sheet to the container, closing the closure cover over the container and clasping a clasp of the cover onto a marginal edge of the container, it is to be understood that the various features of this invention can be used singly or in various combinations thereof for a method of providing a therapeutic regimen for a patient as can hereinafter be appreciated from a reading of the following description.

Figure 1:
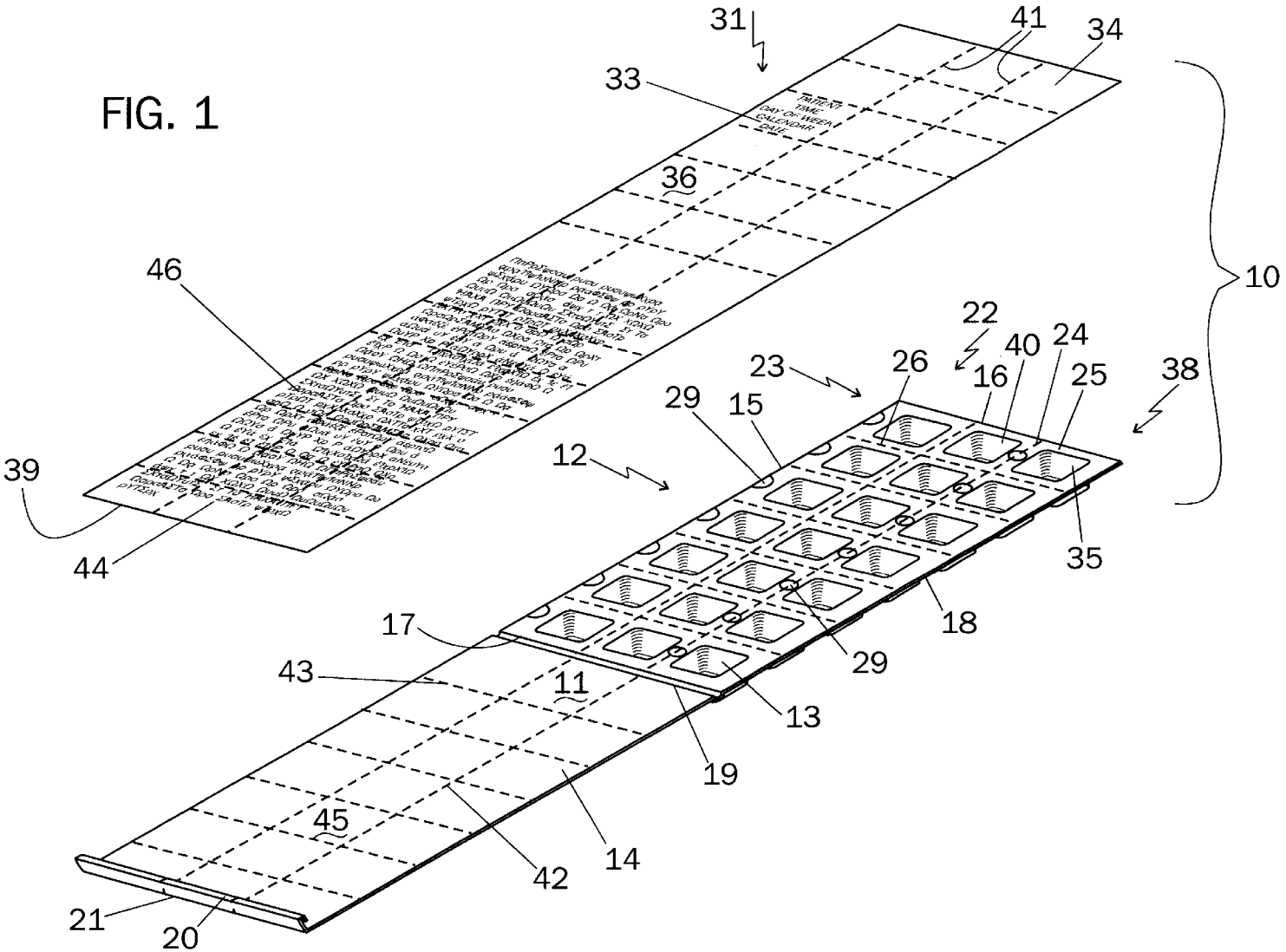
FIG. 1 is a perspective view of an exploded view of the blister package of this invention.
Figure 2:
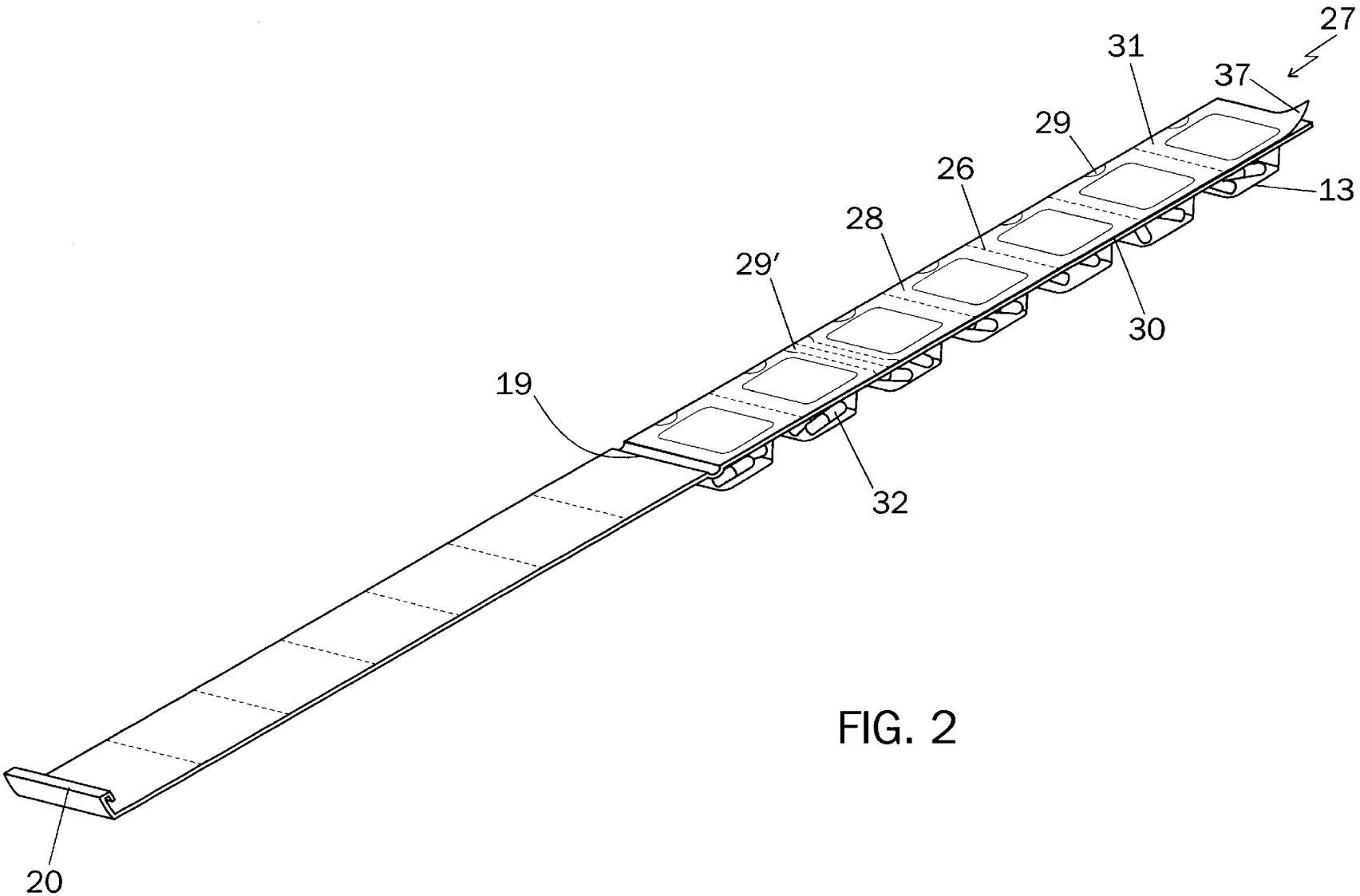
FIG. 2 is a greatly enlarged perspective view of one columnar unit of the blister package of FIG. 1.

Referring now to FIG. 1, an integrated medicament package generally shown with the numeral 10 comprises a prefabricated medicament container 11 having a plurality 12 of initially open top blisters 13, a closure cover 14 affixed to one marginal edge 15–18 thereof by at least one living hinge 19, closure cover 14 having at least one clasp 20 on an open end 21 of closure cover 14 opposite living hinge 19. Plurality 12 of blisters 13 are arranged in rows 22 and columns 23 separated by longitudinal 24 and transverse 25 shoulders, at least one of longitudinal 24 and transverse 25 shoulders having perforations 26 therethrough. Perforations 26 permit prefabricated medicine container 11 to be separated along perforations 26 into a plurality 27 of columnar units 28. At least one of longitudinal 24 and transverse 25 shoulders has cutout 29, best observed in FIG. 2, formed in at least one marginal edge 30 thereof adjacent blisters 13, cutouts 29 adapted to facilitate removal of a sealing sheet 31 thus providing access to medicament 32 in blisters 13. Cutouts 29 are about the size of a person's fingertip, whereby the patient can insert his/her fingertip through the cutout 29 to lift sealing sheet 31 immediately adjacent marginal edge 30 of corresponding blister 13 and as sealing sheet 31 is preferably weakened between adjacent blisters 13 with perforations 41 therethrough, lifting sealing sheet 31 from one blister 13 does not disturb sealing sheet 31 covering adjacent blisters 13. Upon thus raising a piece 37 of sealing sheet 31 from a blister 13, the patient can grab piece 37 and lift piece 37 covering the corresponding blister 13 off of the integrated medicament package 10 thereby exposing medicament 32. The patient can thus conveniently take one dosage of medicament 32 and track his/her daily administration of the medicament 32. Alternately, cutouts 29' may be provided between adjacent blisters 13 as shown in dashed lines in FIG. 2 wherein piece 37 may be lifted from one blister 13 without disturbing piece 37 on the adjacent blister 13.

Sealing sheet 31 has medicament information 33 disposed thereon at a location 34 corresponding to the location 35 of at least one of blisters 13 within columns 23 and rows 22 of prefabricated medicament container 11 such that medicament information 33 on outside surface 36 of sealing sheet 31 corresponds with medicament 32 contained in the corresponding blister 13. Medicament information 33 preferably comprises at least one of the patient's name, the time of day, day of week and/or the calendar date for the patient to take medicament 32 in blister 13 and may also include the doctor's name, the name of medicament 32 and dosage of medicament 32. Thus, when piece 37 of sealing sheet 31 is removed from location 34 by the patient in removing medicament 32 from blister 13, the absence of piece 37 indicates to the patient that medicament 32 has been taken at the appropriate time. Thus, there is a clear advantage over the prior art as the method and apparatus of this invention assists the patient in timely taking a proper dosage of medicament 32 according to the preprinted schedule on outside surface 36 of sealing sheet 31 over each blister 13 having medicament 32 therein and indicating to the patient the time, date and dosage of medicament 32 to be next taken. Preferably, when placing medicament 32 into blisters 13, the pharmacist puts medicament 32 to be first taken by the patient after dispensing of medicament 32 into prefabricated medicament container 11 in a first position 38 in columns 23 and rows 22. After completing a prescription presented by the patient by placing at least one medicament 32 in at least one blister 13, the pharmacist prints sealing sheet 31 on outside surface 36 thereof with medicament information 33 and thereafter aligns medicament information 33 printed on sealing sheet 31 with medicament 32 in the corresponding blisters 13. Initially open blisters 13 are then closed by adhering adherent side 39 of sealing sheet 31 to longitudinal 24 and transverse shoulders 25 of prefabricated medicament container 11. Closure cover 14 is then closed over prefabricated medicament container 11 and at least one clasp 20 is clasped to marginal edge 16 of prefabricated medicament container 11 opposite marginal edge 17 having living hinge 19 provided thereon. It should be fully understood here that automated systems for printing medicament information 33 are well known in the art and that sealing sheets 31 having an adherent side 39 and a printable outside surface 36 are well known. For instance, label sheets such as those that may be obtained from office supply stores may be provided wherein adherent side 39 has an adherent thereon with affinity for longitudinal and transverse shoulders 24, 25 respectively. Alternately, adherent side 39 may have adhesive arranged in columns and rows corresponding exactly to longitudinal and transverse shoulders 24, 25 respectively thus avoiding possibility of contact of any adhesive material with medicament 32.

The method of this invention of providing a therapeutic regimen for a patient comprises a first step of selecting prefabricated medicament container 11 having rows 22 and columns 23 corresponding to the course of medicament 32 prescribed by the doctor or corresponding to the course of medicament 32, if available over the counter, corresponding to the regimen desired by the patient. It should be readily apparent here, that integrated medicament package 10 may be created for a doctor's prescription of a course of medication which may comprise a plurality of individual prescriptions, a vitamin regimen desired by the patient, a course of over-the-counter medicaments useful in treating common ailments or a combination of the above without departing from the teachings of this invention. The method of this invention continues with the step of dispensing at least one medicament 32 of the aforementioned therapeutic regimen into at least one of plurality 12 of initially open blisters 13 of prefabricated medicament container 11 previously described, followed by the step of printing an outside surface 36 of sealing sheet 31 with medicament information 33 at a location 35 corresponding to the placement of medicament 32 in plurality 12 of blisters 13. In the step of dispensing medicament 32, medicament 32 is arranged in prefabricated medicament container 11 such that medicament 32 to be first taken by the patient after dispensing of medicament 32 into prefabricated medicament container 11 and completing the remaining steps of the method, places medicament 32 in a first position 38 in columns 23 and rows 22 such that it is clear to the patient when to begin the course of medication established in the first step. As medicament information 33 contains the date and time of taking each medicament 32 in integrated medicament package 10 and the first such medicament 32 is placed in first position 38, the patient can be assured that the course established can be carried out in a logical fashion and removal of piece 37 hereinbefore described readily assures the patient that medicament 32 has been taken at the prescribed time. For instance, a patient is prescribed two different medicaments 32 for seven days for a particular ailment to be taken at different times of the day, say one in the morning and one in the afternoon starting with the afternoon medicament 32 on a particular day of the week after a doctor's appointment. Thus, the pharmacist selects prefabricated medicament container 11 having two columns 23 of seven rows 22 and places the afternoon medicament 32 in the first column 23 such that the first afternoon medicament 32 is in first position 38. The second medicament 32 is therefore obviously in the second column 23. The method continues with the step of aligning medicament information 33 printed on sealing sheet 31 with medicament 32 in plurality 12 of blisters 13, thus placing medicament information 33 for the afternoon medicament 32 in first column 23 with first position 38 having a time, say 4:00 p.m., and a date, say Tuesday, Mar. 26, 2002, printed on outside surface 36. Likewise, second medicament 32 placed in second column 23 would have a time, say 8:00 a.m. and the following date, Wednesday, Mar. 27, 2002 printed on outside surface 36 aligned with the corresponding blister 13 of plurality 12. Remaining rows 22 would therefore have dates Wednesday, Mar. 27, 2002 through Monday, Apr. 1, 2002. Upon aligning medicament information 33 with medicament 32, a step of closing initially open blisters 13 is accomplished by adhering adherent side 39 of sealing sheet 31 to longitudinal and transverse shoulders 24, 25 respectively of prefabricated medicament container 11. Prior to providing integrated medicament package 10 to the patient, the pharmacist completes integrated medicament package 10 with the step of closing closure cover 14 over prefabricated medicament container 11 having sealing sheet 31 adhered thereto and the step of clasping at least one clasp 20 to one of marginal edges 15–18 of prefabricated medicament container 11 opposite marginal edge 18–15 having at least one living hinge 19 thereon and as shown in FIG. 1, clasp 20 on open end 21 of closure cover 14 would be clasped over marginal edge 16 of prefabricated medicament container 11 opposite marginal edge 17 having living hinge 19.

In the method described above, the step of dispensing medicament 32 comprised dispensing a different medicament 32 in an adjacent one 40 of plurality 12 of blisters 13 wherein medicament 32 in adjacent one 40 was to be taken by the patient at a time 8:00 a.m., Wednesday, Mar. 27, 2002, spaced from the time 4:00 p.m., Tuesday, Mar. 26, 2002 the patient was to take medicament 32 in first one position 38 of plurality 12 of blisters 13 though other courses of medication are contemplated. For instance, the method of providing a course of medication in plurality 12 of blisters 13 of integrated medicament package 10 may comprise the step of providing the same medicament 32 in adjacent one 40 of plurality 12 of blisters 13, medicament 32 in adjacent one 40 to be taken by the patient at a time spaced from the time patient is to take medicament 32 in first position 38 as would be the case in taking a vitamin at the beginning of each meal wherein prefabricated medicament container 11 would be selected to have three columns 23 and seven rows 22. Outside surface 36 of sealing sheet 31 over first position 38 thus has date and time indicia thereon corresponding to the meal and day first occurring after dispensing of medicament 32. Integrated medicament package 10 thus dispensed provides the patient with medicament 32 corresponding to one week's therapeutic regimen arranged in seven day rows 22 and morning, midday and evening columns 23 with first position 38 and the first column 23 corresponding to the morning, midday or evening meal first occurring after dispensing of medicament 32. Likewise, it is also contemplated that one month's therapeutic regimen may be arranged in seven rows 22 corresponding to the days of the week and four weekly columns 23 corresponding to the weeks of the month. Other combinations of rows 22 and columns 23 for specific courses of medication may be selected by the pharmacist. Alternately, rows 22 and/or columns 23 may be color coded as a color reference to the patient for a particular medicament.

Preferably, in the method step of providing sealing sheet 31, an additional step of providing perforations 41 through sealing sheet 31 is done wherein perforations 41 in sealing sheet 31 are aligned with perforations 26 in longitudinal and transverse shoulders 24, 25 respectively during the step of closing initially open blisters 13. It is also preferred that an additional step of providing perforations 42 lengthwise through closure cover 14 and extending perforations 42 in closure cover 14 through living hinge 19 and through clasp 20 is accomplished wherein closure cover 14, prefabricated medicament container 11 and sealing sheet 31 may be separated at perforations 26, 41, 42 into separate columnar units 28 shown in FIG. 2. As perforations 42 in closure cover 14 are aligned with perforations 26 in longitudinal shoulders 24 and sealing sheet 31, each columnar unit 28 thereby comprises an integrated medicament package 10 having clasp 20 and living hinge 19 whereby medicament 32 to be taken by the patient as printed on outside surface 36 of sealing sheet 31 at substantially the same time of each day enables the patient to place columnar unit 28 at a location wherein the patient is most likely to reside at the time specified for taking specific medicament 32 in blisters 13 of columnar unit 28. Thus, in an integrated medicament package 10 having three columns 23 of seven blisters 13, the patient may keep the midday medicament 32 in a desk drawer at work by separating the midday columnar unit 28 from integrated medicament package 10 while retaining columnar units 28 with the morning and evening medications at home.

It is also contemplated in this method to include another step of providing perforations 43 transversely across closure cover 14 thereby establishing transverse perforations 43 through closure cover 14 aligned with perforations 26 in prefabricated medicament container 11 and perforations 41 in sealing sheet 31 wherein closure cover 14, prefabricated medicament container 11 and sealing sheet 31 may be separated at perforations 26, 41, 43 into separate row-like units similar to columnar units 28 whereby a daily regimen having been dispensed in plurality 12 of blisters 13 allows the patient to carry the row-like unit along while the patient is remote from the location where the patient retains the remainder of the therapeutic regimen. Where integrated medicament package 10 is separated into row-like units at perforations 43, living hinge 19 would be provided on marginal edge 16 or 18 while clasp 20 would clasp over the free marginal edge 18 or 16. Generally, however, a daily regimen may be better arranged in prefabricated medicament container 11 having four columns 23 of seven rows 22 wherein the patient proceeds down each column 23 through the days of the week until blisters 13 in column 23 are all emptied, whereafter that column 23 may be separated from integrated medicament package 10 and discarded, exposing next column 23 and cutouts 29.

Most medications are provided with certain drug reaction and side effects information for perusal by the patient, however, this information is generally provided on a sheet separate from the medication. Thus, the method of this invention also comprises a further step of providing a section 44 of sealing sheet 31 that extends across living hinge 19 and is adhered to an inside surface 45 of closure cover 14 wherein section 44 has drug reaction and side effect information relative to medicament 32 contained in plurality 12 of blisters 13 printed on outside surface 36. Thus, the patient has drug reaction and side effect information relative to medicament 32 readily available by referring to section 44 of sealing sheet 31 adhered to inside surface 45 of closure cover 14. Drug reaction and side effect information is represented in FIG. 1 by the greeking 46.

Though it may appear to the reader hereof that each blister 13 contains only one medicament 32 therein, it is also contemplated in the method of this invention to include the step of dispensing a plurality of distinct medicaments 32 in at least one of initially open blisters 13 and more particularly, to dispense a plurality of distinct medicaments 32 in each of initially open blisters 13 provided that medicaments 32 are intended to be taken together or at least at the same time. In fact, it is contemplated within the teachings of this invention to provide for prefabricated medicament containers 11 having a variety of sizes of blisters 13, a variety of columns 23 and a variety of rows 22.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A method of providing a therapeutic regimen for a patient comprises the step of placing at least one medicament of said therapeutic regimen into at least one initially open blister of a prefabricated medicament container having a plurality of said open blisters, said prefabricated medicament container further having a closure cover affixed to one marginal edge thereof by at least one living hinge, said closure cover having at least one clasp on an open end of said closure cover opposite said at least one said living hinge, said plurality of said blisters arranged in rows and columns separated by longitudinal and transverse shoulders, at least one of said longitudinal and said transverse shoulders having perforations therethrough wherein said prefabricated medicine container is adapted to be separated along said perforations into a plurality of units, at least one of said longitudinal and said transverse shoulders having cutouts formed in at least one marginal edge thereof adjacent said blisters, said cutouts adapted to facilitate removal of a sealing sheet providing access to said medicament in said blisters, the step of printing an outside surface of said sealing sheet with medicament information at a location corresponding to said at least one said initially open blister such that said medicament information on said outside surface of said sealing sheet corresponds with said at least one said medicament in said at least one said initially open blister, said medicament information comprising at least one of the name of said patient, the time of day, the day of week and/or the calendar date for said patient to take said medicament in said at least one said blister, the name of the doctor, the name of said medicament and/or the dosage of said medicament, said sealing sheet, when removed from said location indicates to said patient that said at least one said medicament has been taken, the step of arranging said at least one said medicament in said prefabricated medicament container wherein said medicament to be taken by said patient after said step of placing said at least one said medicament into said prefabricated medicament container is in a first position in said columns and said rows, the step of aligning said medicament information printed on said sealing sheet with said medicament in said at least one said blister, the step of closing said at least one said initially open blister by adhering said sealing sheet to said longitudinal and said transverse shoulders of said prefabricated medicament container, the step of closing said closure cover over said prefabricated medicament container and the step of clasping said at least one said clasp to a marginal edge of said prefabricated medicament container opposite said marginal edge having said at least one said living hinge.

2. A method as in claim 1 wherein said medicament in said one said plurality of said blisters further comprises the step of providing a different said medicament in an adjacent one of said plurality of said blisters, said medicament in said adjacent one of said plurality of said blisters to be taken by said patient at a time spaced from the time said patient is to take said medicament is said one said plurality of said blisters.

3. A method as in claim 1 wherein said medicament in said one said plurality of said blisters further comprises the step of providing the same said medicament in an adjacent one of said plurality of said blisters, said medicament in said adjacent one of said plurality of said blisters to be taken by said patient at a time spaced from the time said patient is to take said medicament is said one said plurality of said blisters.

4. A method as in claim 1 comprises the additional step of providing perforations through said sealing sheet wherein said perforations in said sealing sheet are aligned with said perforations in said longitudinal and said transverse shoulders during said step of closing said at least one said initially open blister.

5. A method as in claim 4 comprises an additional step of providing perforations through said closure cover wherein said perforations in said closure cover are aligned with said perforations in said longitudinal and said transverse shoulders and said sealing sheet.

6. A method as in claim 5 comprises another step of extending said perforations in said closure cover through said living hinge, lengthwise of said closure cover and through said clasp wherein said closure cover, said prefabricated medicament container and said sealing sheet are separated at said perforations into separate columnar units.

7. A method as in claim 6 comprises a step of providing a specific medicament in each of said plurality of said blisters of said separate columnar units wherein said specific medicament is to be taken by said patient as printed on said outside surface of said sealing sheet at substantially the same said time of said day whereby said patient places said columnar unit at a location wherein said patient is most likely to reside at said time specified for taking said specific medicament.

8. A method as in claim 5 comprises a step of extending said perforations transversely across said closure cover thereby establishing transverse perforations through said closure cover, said prefabricated medicament container and said sealing sheet wherein said closure cover, said prefabricated medicament container and said sealing sheet may be separated at said perforations into separate row-like units.

9. A method as in claim 8 comprises a step of providing a daily regimen of said medicament in said plurality of said blisters of said row-like unit wherein said daily regimen of medicament in said separate row-like unit is to be taken by said patient as printed on said outside surface of said sealing sheet whereby said patient carries said row-like unit while said patient is remote from the location wherein said patient retains the remainder of said regimen.

10. A method as in claim 1 comprises a further step of providing a section of said sealing sheet that extends across said living hinge and is adhered to an inside surface of said closure cover, said section of said sealing sheet adhered to said inside surface of said closure cover having drug reaction and side effect information relative to said medicament contained in said plurality of said blisters printed on an exterior surface of said sealing sheet adhered to said inside surface of said closure cover.

11. A method as in claim 1 wherein said step of placing said at least one said medicament of said therapeutic regimen in said at least one said initially open blister comprises the step of placing a plurality of distinct medicaments in said at least one said initially open blister.

12. A method as in claim 1 wherein said therapeutic regimen dispensed in said prefabricated medicament container, closing said prefabricated medicament container with said sealing sheet, closing said closure cover over said prefabricated medicament container by clasping said at least one said clasp over said marginal edge comprises the step of providing said medicament in said plurality of said blisters corresponding to one week's therapeutic regimen arranged in seven day row-like units and morning, midday and evening columnar units.

13. A method as in claim 11 wherein said therapeutic regimen dispensed in said prefabricated medicament container, closing said prefabricated medicament container with said sealing sheet, closing said closure cover over said prefabricated medicament container by clasping said at least one said clasp over said marginal edge comprises the step of providing said medicament in said plurality of said blisters corresponding to one week's therapeutic regimen arranged in seven day row-like units and morning, midday and evening columnar units.

14. A method as in claim 1 wherein said therapeutic regimen dispensed in said prefabricated medicament container, closing said prefabricated medicament container with said sealing sheet, closing said closure cover over said prefabricated medicament container by clasping said at least one said clasp over said marginal edge comprises the step of providing said medicament in said plurality of said blisters corresponding to one month's therapeutic regimen arranged in seven day row-like units corresponding to the days of the week and four weekly columnar units corresponding to the weeks of said month.

15. A method as in claim 1 wherein said step of printing said outside surface of said sealing sheet with said medicament information further comprises the step of printing said outside surface of said sealing sheet with a contrasting color for each of said columns.

16. A method as in claim 1 wherein said step of printing said outside surface of said sealing sheet with said medicament information further comprises the step of printing said outside surface of said sealing sheet with a contrasting color for each of said rows.

17. A method of providing a therapeutic regimen for a patient comprises:

the step of placing at least one medicament of said therapeutic regimen into a prefabricated medicament container, the step of printing an outside surface of a sealing sheet with medicament information, the step of arranging said at least one said medicament in said prefabricated medicament container wherein said medicament to be first taken by said patient after said step of placing said at least one said medicament into said prefabricated medicament container is in a first position in a first column and a first position in a first row of said prefabricated medicament container, the step of aligning said medicament information printed on said sealing sheet with said medicament in said prefabricated medicament container, the step of closing said prefabricated medicament container by adhering said sealing sheet to said prefabricated medicament container, the step of closing said closure cover over said prefabricated medicament container and the step of clasping said at least one said clasp to a marginal edge of said prefabricated medicament container, the step of providing means for removing a piece of said sealing sheet from said one of said plurality of blisters wherein said patient, after removing said piece of said sealing sheet and discarding said piece, removing said at least one said medicament from said blister and taking said at least one said medicament is subsequently reminded that said at least one said medicament has been taken by the absence of said piece from said prefabricated medicament container.

18. A method as in claim 17 wherein said step of printing said outside surface of said sealing sheet with said medicament information further comprises the step of printing said outside surface of said sealing sheet with a contrasting color for each of said columns.

19. A method as in claim 17 wherein said step of printing said outside surface of said sealing sheet with said medicament information further comprises the step of printing said outside surface of said sealing sheet with a contrasting color for each of said rows.

20. An integrated medicament package comprises:

a prefabricated medicament container having a plurality of initially open top blisters, a closure cover affixed to one marginal edge thereof by at least one living hinge, said closure cover having at least one clasp on an open end of said closure cover opposite said at least one said living hinge, said plurality of said blisters arranged in rows and columns separated by longitudinal and transverse shoulders, at least one of said longitudinal and said transverse shoulders having perforations therethrough wherein said prefabricated medicine container is adapted to be separated along said perforations into a plurality of units, at least one of said longitudinal and said transverse shoulders having cutouts formed in at least one marginal edge thereof adjacent each said plurality of said blisters, said cutouts adapted to facilitate removal of a sealing sheet providing access to said medicament in said each of said plurality of said blisters, a sealing sheet with medicament information at a location corresponding to said at least one said plurality of blisters such that said medicament information on said outside surface of said sealing sheet corresponds with said at least one said medicament in said at least one said plurality of said blisters, said medicament information comprising the name of said patient, the name of said medicament, the dosage of said medicament, the time of day, the day of week and the calendar date for said patient to take said medicament in said at least one said plurality of said blisters, said sealing sheet when removed from said location indicates to said patient that said at least one said medicament has been taken, wherein said at least one said medicament to be taken by said patient after said placing of said at least one said medicament into said prefabricated medicament container is in a first position in said columns and said rows, whereafter upon aligning said medicament information printed on said sealing sheet with said medicament in said at least one said plurality of blisters, said at least one said initially open blister is closed by adhering said sealing sheet to said longitudinal and said transverse shoulders of said prefabricated medicament container, said closure cover is closed over said prefabricated medicament container and at least one said clasp is clasped to a marginal edge of said prefabricated medicament container opposite said marginal edge having said at least one said living hinge.

* * * * *